US005470138A

United States Patent [19]

Kump

[11] Patent Number: 5,470,138

[45] Date of Patent: Nov. 28, 1995

[54] COUPON DISPLAY AND DISPENSER DEVICE

[75] Inventor: Daniel J. Kump, Mentor, Ohio

[73] Assignee: Fasteners for Retail, Inc., Cleveland, Ohio

[21] Appl. No.: 132,508

[22] Filed: Oct. 5, 1993

[51] Int. Cl.[6] ..... A47F 7/00

[52] U.S. Cl. ..... 312/34.4; 312/50; 206/39.5

[58] Field of Search ..... 312/34.1, 34.4, 312/50; 221/35, 45, 59, 63, 58, 56; 206/39.5, 39.6, 39.7, 39

[56] References Cited

U.S. PATENT DOCUMENTS

| | | | |
|---|---|---|---|
| D. 252,434 | 7/1979 | Wright . | |
| D. 302,704 | 8/1989 | Krautsack . | |
| D. 306,541 | 3/1990 | Krautsack . | |
| 435,352 | 8/1890 | Bromberg . | |
| 686,289 | 11/1901 | Grove . | |
| 846,741 | 3/1907 | Fraser . | |
| 1,155,737 | 10/1915 | Kinzie . | |
| 1,333,610 | 3/1920 | Fellheimer . | |
| 3,286,823 | 11/1966 | Gillespie . | |
| 3,421,658 | 1/1969 | Cooksey | 206/39.5 X |
| 3,549,226 | 12/1970 | Samson | 312/50 |
| 3,927,442 | 12/1975 | Foster | 206/39 X |
| 4,130,197 | 12/1978 | Fox . | |
| 4,179,138 | 12/1979 | Bogdanovic . | |
| 4,623,073 | 11/1986 | Hansen . | |
| 4,805,331 | 2/1989 | Boggess et al. . | |
| 4,899,886 | 2/1990 | Johansen | 206/39.6 X |
| 4,909,464 | 3/1990 | Levine et al. . | |
| 4,953,746 | 9/1990 | Andriash . | |

*Primary Examiner*—Kenneth J. Dorner
*Assistant Examiner*—Gerald A. Anderson
*Attorney, Agent, or Firm*—Fay, Sharpe, Beall, Fagan, Minnich & McKee

[57] ABSTRACT

A device for displaying sheets of promotional material includes a frame having a rear wall, a front wall, a pair of side walls, a top wall, and a bottom wall. The walls cooperate to define a sheet receiving cavity. A hinge can be provided for pivotally mounting the front wall or cover from the remainder of the frame. Alternatively, the cover can be a separate element secured by a catch to the remainder of the frame. A bracket construction is located on the rear wall for securing the frame to an associated support member. A slot is defined along one of the side walls for allowing the withdrawal of sheets, such as coupons and the like, one at a time from the cavity.

24 Claims, 7 Drawing Sheets

FIG. 6
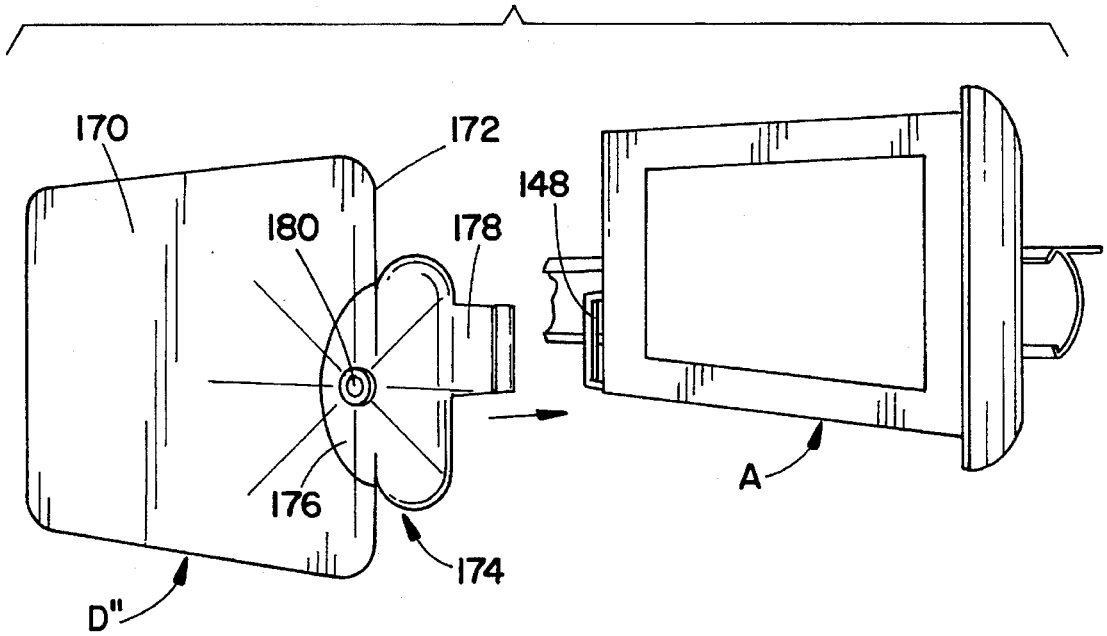
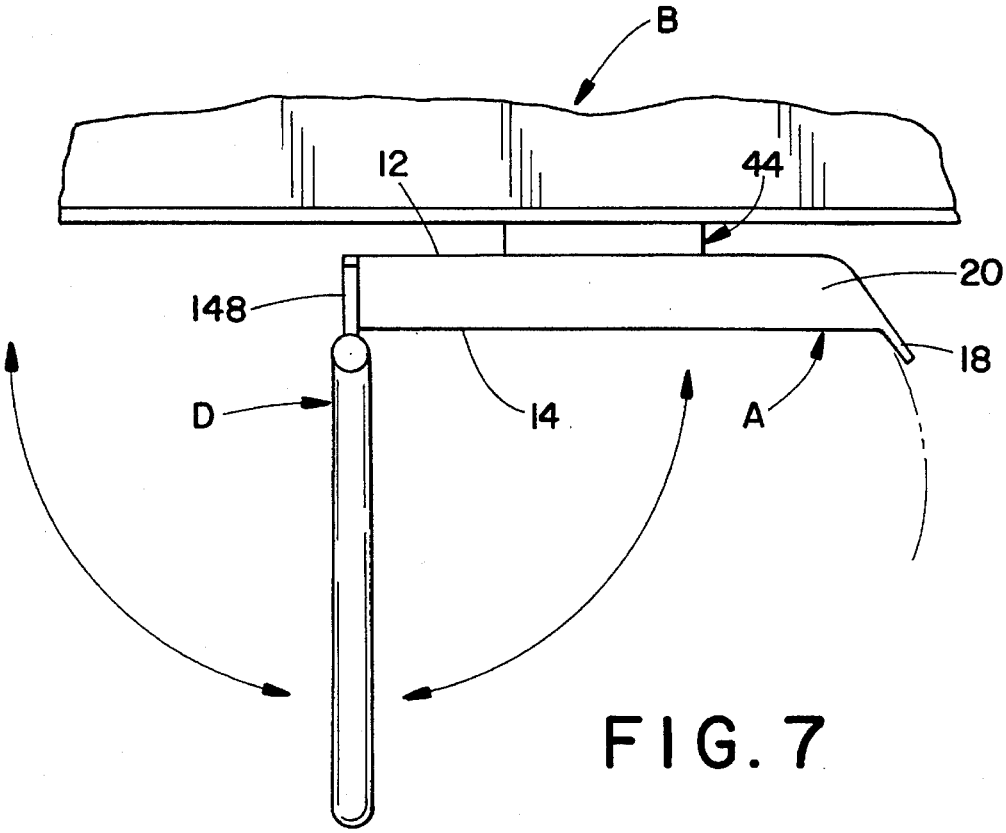
FIG. 7

COUPON DISPLAY AND DISPENSER DEVICE

BACKGROUND OF THE INVENTION

The present invention relates to the display and dispensing of promotional material. More particularly, the present invention relates to an in-store promotional device.

The present invention is particularly applicable to a coupon display and dispenser device utilized in a store for promoting the sale of a featured item. However, it should be appreciated that the device of the present invention can also be utilized for numerous related applications.

Refund and rebate sheet holders are conventionally used in stores for featured sales items. However, such holders are generally not provided adjacent to the product with which they are associated. Conventional dispensers which are mounted adjacent to the sales items, such as sheet holders which are mounted to a rail at the front end of a shelf, such as a grocery store shelf, are disadvantageous because they allow a customer to remove as many coupons as he desires at one time, instead of dispensing only one coupon per customer.

Recently some one-at-a-time coupon dispensers have been introduced. These are mounted transversely to the front end of a grocery store shelf so as to allow coupons to be dispensed therefrom. However, such dispensers may obstruct the vision of an approaching customer, as well as the movement of such customer, even if the dispenser can be pushed out of the way by the customer or the customer's shopping cart. In addition, such known pivotable coupon dispensers are fairly expensive to manufacture and are prone to damage since they will be hit and pivoted out of the way by customers or their shopping carts.

Accordingly, it has been considered desirable to develop a new and improved coupon dispenser, which would overcome the foregoing difficulties and others while providing better and, more advantageous overall results.

BRIEF SUMMARY OF THE INVENTION

In accordance with the present invention, a device is provided for displaying and dispensing sheets of promotional material.

More particularly in accordance with this aspect of the invention, the device comprises a box-like frame member defining a cavity, the frame having an open front face. A cover selectively closes the open front face of the frame member. A catch means is provided for securing the cover in a closed position on the frame member. The frame open front face, when the cover is not secured to the frame member, allows a bulk loading of sheets into the cavity. The cover prevents sheets from falling out of the cavity. A dispensing opening is provided for dispensing individual sheets from the cavity. The dispensing opening is defined by a curving wall of the frame member.

If desired, the cover can be hingedly attached to the frame member. Alternatively, the cover can be a separate member that is selectively attached by the catch means to the frame member. If the cover is hingedly attached to the frame member, the entire device can be of one piece.

An adaptor can also be provided to cooperate with the bracket construction and enable the frame to be mounted from another support member. The cover can include a window through which the sheets can be viewed. The cover can also include a finger receiving opening to allow an observer to manually grasp a sheet for extraction from the cavity.

The device can further comprise a sign and a clip. The clip can have first and second ends, with the sign being secured to the first end of the clip. A mounting structure can be located in a side wall of the frame opposite the slot, with the second end of the clip being selectively insertable into the mounting structure to secure the sign to the frame. A plane in which the sign extends can be substantially normal to a plane in which the frame back wall extends. The device can further comprise a first means for permitting the sign to pivot around a vertical axis in relation to the frame, and a second means for biasing the sign to an orientation substantially normal to the orientation of the frame.

One advantage of the present invention is the provision of the new and improved display and dispensing device for promotional material.

Another advantage of the present invention is the provision of a display and dispensing device which can be bulk loaded with sheets of promotional material but allows only one sheet of material to be removed at a time.

Still another advantage is of the present invention is the provision of a dispensing device which does not obstruct movement by shopping carts along the aisle in which the device is located.

A further advantage of the present invention is the provision of a display and dispensing device, which can be adapted for use on many types of support members, such as peg boards, UPC hooks, peg board hooks, wire baskets, conventional shelves, and C-channel shelves.

A still further advantage of the present invention is the provision of a display and dispensing device that can selectively have a sign mounted thereto. The sign can be located in a plane perpendicular to the plane of the device, if desired, and can pivot out of the way of shoppers.

A yet further advantage of the present invention is the provision of a display and dispensing device that includes a box-like frame member defining a cavity, having an open front face and a cover for closing the front face. The cover can be pivotally mounted to the frame member via an integral hinge, if desired. Alternatively, the cover can be a separate member which is selectively secured by catch means to the frame member.

An additional advantage of the present invention is the provision of a display and dispensing device for promotional material in which sheets are held in the device in a plane parallel to a plane of the device but in which sheets are dispensed from the device in a plane perpendicular to the plane of the device. In this way, the sheets can be dispensed in a wrinkle-free manner.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, several preferred embodiments of which will be described in detail in this specification and illustrated in the accompanying drawings, in which form a part hereof and wherein:

FIG. 6 is an exploded perspective view of the device of FIG. 1, showing a third type of sign securable thereto;

FIG. 7 is an assembled top plan view of the device of FIG. 4;

DETAILED DESCRIPTION OF THE PREFERRED EMBODIMENTS

Figure 1:
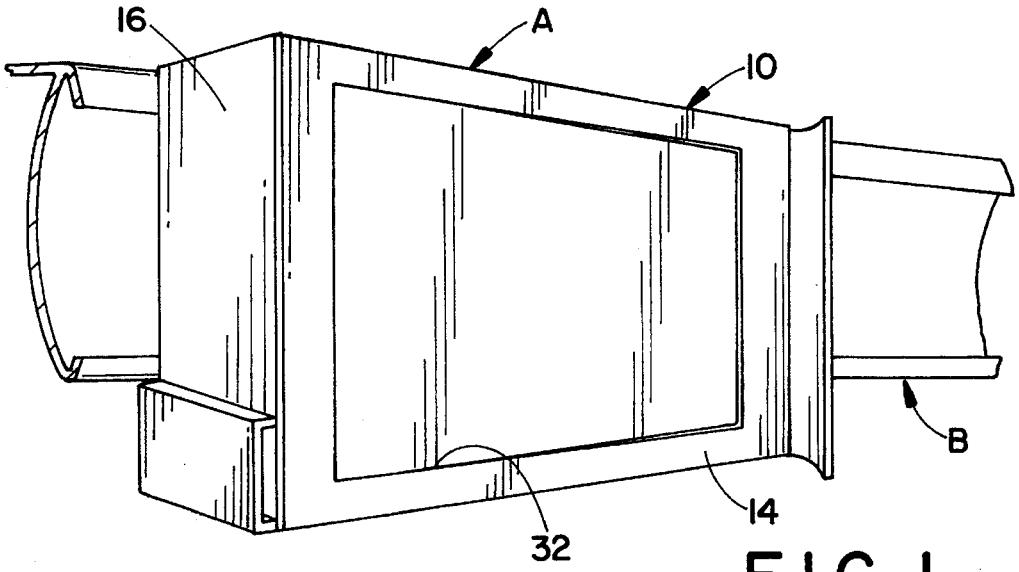
FIG. 1 is a perspective view of a display and dispensing device according to a first embodiment of the present invention.

Referring now to the drawings, wherein the showings are for purposes of illustrating several preferred embodiments of the invention only and not for purposes of limiting same, FIG. 1 shows a display and dispensing device A, according to the present invention, being mounted to an associated support member B. The device is primarily designed for, and will hereinafter be described in connection with the display and dispensing of coupons and the like in a retail store setting. However, it-should be appreciated that the overall inventive concept involved could be adapted for use in other environments as well.

Figure 2:
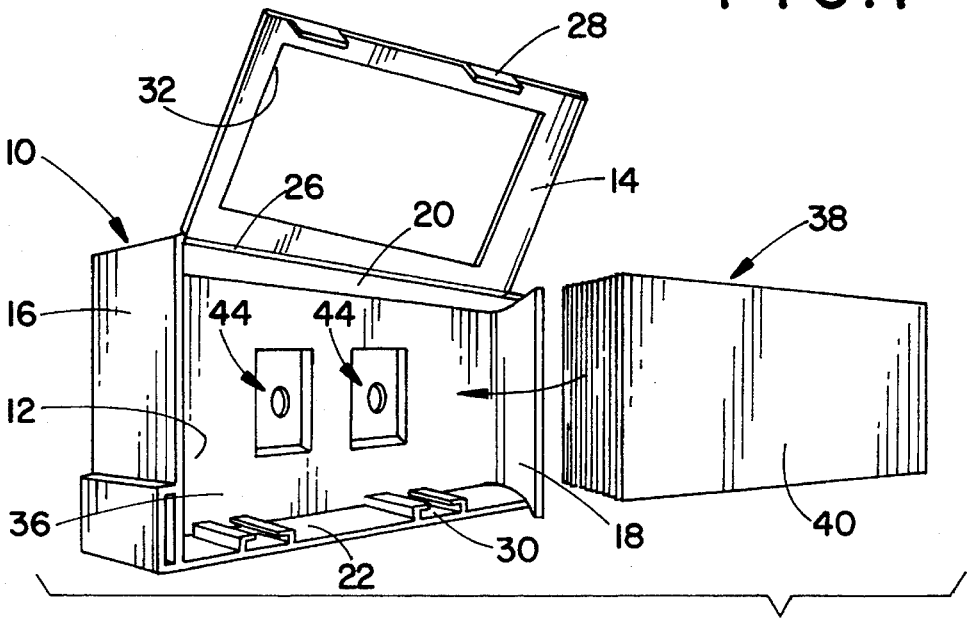
FIG. 2 is a reduced scale perspective view of the device of FIG. 1 in an open position so as to accommodate a stack of sheets.
Figure 3:
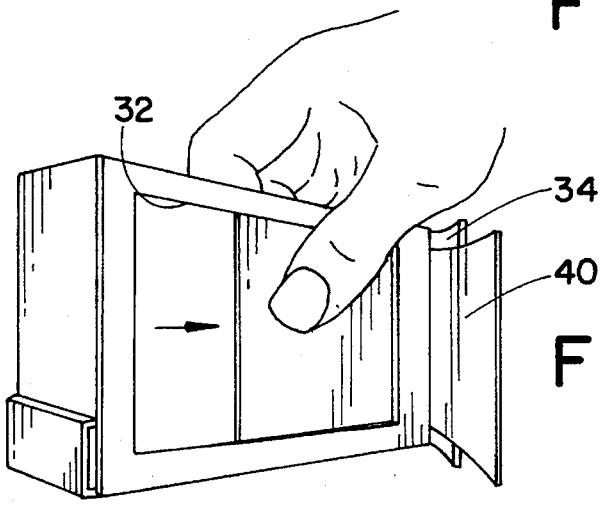
FIG. 3 is a perspective view of the device of FIG. 2, in a closed position, shown as dispensing a single sheet.

With reference now to FIG. 2, the coupon dispenser A includes a frame 10 having a rear wall 12, a front wall 14, first and second side walls 16,18, a top wall 20, and a bottom wall 22. A hinge 26 pivotally mounts the front wall 14 from the remainder of the frame 10. In the embodiment of FIG. 2, the hinge 26 is located along the front edge of the top wall 20. A catch means is also provided for selectively securing the front wall 14 in a closed position against the remainder of the frame 10. To this end, the catch means comprises a pair of spaced tabs 28 located along a bottom edge of the front wall 14. These tabs 28 cooperate with suitably shaped and located tab housings 30 defined along the bottom wall 22. In this way, the front wall 14 can be pivoted from its open position shown in FIG. 2 to its closed and locked position as shown in FIG. 3.

Located in the front wall 14 is a window 32. This is essentially just a frame with no glass over it. In other words, the window 32 is open. Formed by the second side wall 18 and the front wall 14 is a dispensing opening 34 as evident from FIG. 3. With the front wall 14 in the open position shown in FIG. 2, a sheet receiving cavity 36 is provided for accommodating a stack of sheets 38. The dispensing opening 34, on the other hand, provides a second opening for dispensing individual sheets 40 of the stack of sheets 38 accommodated in the cavity 36 once the front wall 14 is closed against the remainder of the frame 10.

It is noted that the sheets 40 are displayed in an orientation substantially parallel to a plane extending through the frame 10. In contrast, as seen in FIG. 3, the sheets are dispensed in an orientation that is substantially perpendicular to the plane in which the sheets are being displayed. This is due to the curved nature of the second side wall 18 as is evident from FIG. 3 of the drawings. Therefore, the sheets 40 are not wrinkled as they are being dispensed and slide smoothly out of the dispenser A as guided along the curved surface 18.

When the stack of sheets 38 is loaded into the dispenser A, they can be withdrawn one at a time from the dispenser by grasping the top sheet 40 through the open window 32 with one or more digits of a hand and pushing that sheet towards the second side wall 18. Thus the window 32 serves both as a means for displaying the sheets 40 and as a means for accessing the sheets 40. The sheet will then slide out the slot 34 in an orientation normal to the stack of sheets 38 since the travel path of the sheet is curved because the second side wall 18 is curved. This is clearly shown in FIG. 3 of the drawings.

Also, the curved nature of the travel path of each sheet and the curved nature of the second side wall 18 can be seen in FIG. 7 of the drawings. It is noted that only one sheet at a time can be withdrawn from the dispenser A since the slot 34 is narrow and the sheets 40 will tend to slide in relation to each other relatively readily because conventional promotional material sheets such as, e.g., coupons and the like are usually made from a slick type of paper.

Figure 13:
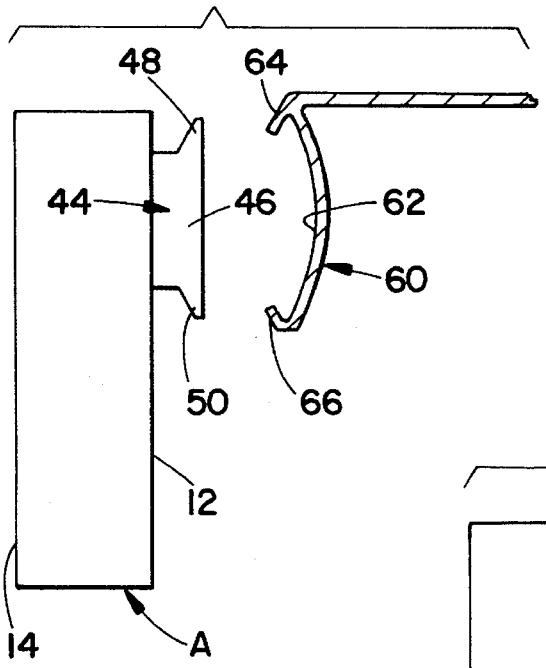
FIG. 13 is a side elevational view of the display and dispensing device of FIG. 1 being secured to a C-channel located at the front of a display shelf.

The display and dispensing device also includes a bracket construction 44 extending rearwardly from the rear wall 12 thereof. As is evident from FIG. 2, two spaced such constructions 44 are provided in the back wall 12. With reference now to FIG. 13, each construction includes a substantially rectangular extension 46 having at its upper and lower edges a respective flange 48,50.

While the frame 10 could be made from any suitable, conventional material, one acceptable type of material is a thermoplastic such as polypropylene. The device A could be, for example, injection molded. Therefore, the device would be of one piece such that the hinge 26 integrally connects the front wall 14 to the remainder of the frame.

The bracket construction is suitably sized so as to be accommodated in a C-channel 60 located at the front edge of a suitably configured shelf, as is known to the art. Such channels generally include a concave opening 62 which is bounded at its top and bottom edges by inwardly turned flanges 64,66. The first and second flanges 48,50 of the bracket construction 44 are adapted to engage the first and second flanges 64,66 of the C-channel in order to hold the display and dispensing assembly A in place on the support member as is evident from FIG. 1. The device A can be slid along the C-channel to the desired location on the shelf.

Figure 11:
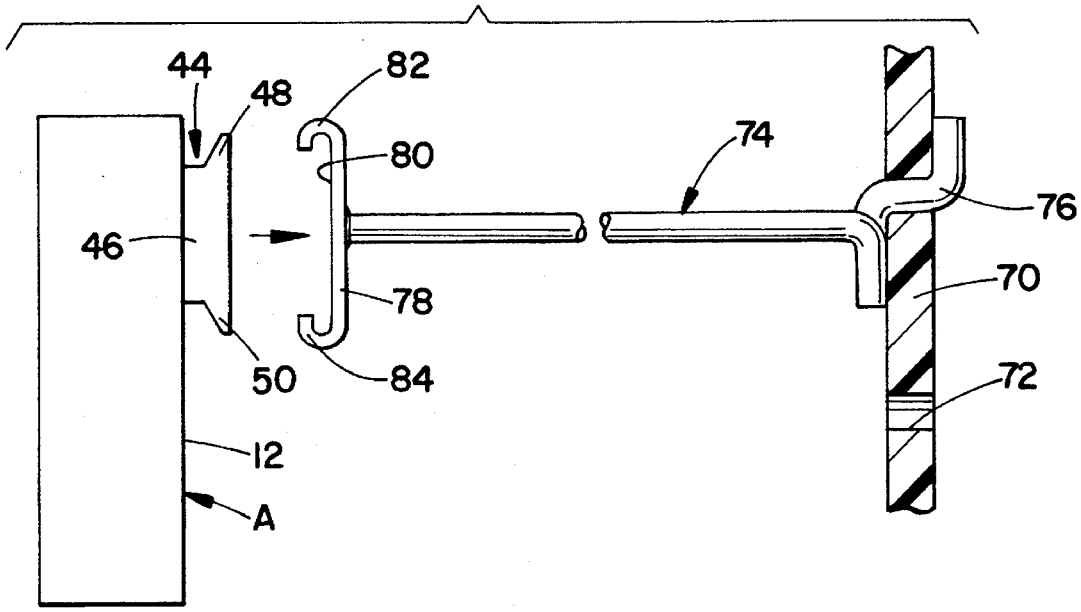
FIG. 11 is a side elevational view of the display and dispensing device of FIG. 1 being secured to a pegboard hook.

With reference now to FIG. 11, the display and dispenser device A can also be utilized in such a way that it is secured to a peg board 70 including a plurality of holes 72 extending therethrough. One known way of securing an object to a pegboard is through the use of a known pegboard hook 74. Such a hook includes a mounting end 76 and a receiving end 78 that comprises an opening 80 flanked at its top and bottom edges by inwardly turned flanges 82,84. These flanges 82,84 cooperate with the bracket construction flanges 48,50 on the rear face 12 of the device A. In this way, the device can be removably secured to the hook 74 and hence to the pegboard 70.

Figure 10:
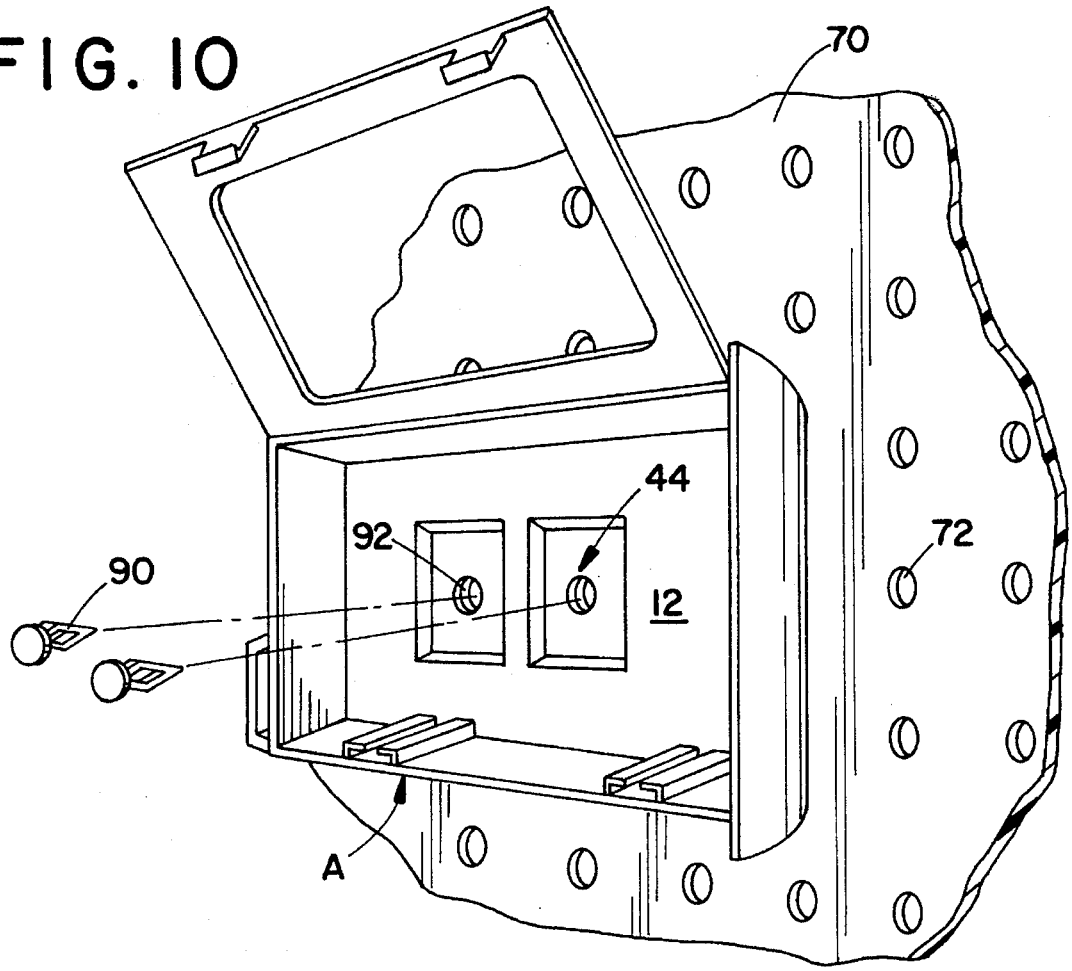
FIG. 10 is a perspective view of the display and dispensing device of FIG. 1 being secured to a pegboard.

With reference now to FIG. 10, instead of utilizing a pegboard hook to secure the display and dispensing device A to a pegboard, one could instead utilize conventional dart clips 90 which are suitably sized to extend through apertures 92 provided in the rectangular extension 46 of the bracket construction 44 on the rear surface 12 of the frame 10. The holes 92 are aligned with the holes 72 of the pegboard 70. Such clips 90, therefore, enable one to removably secure the device A to the pegboard 70. It should be evident that the size, shape and spacing of the bracket construction 44 is entirely dependent upon the types of support members to which the display and dispensing device A is meant to be secured.

Figure 9:
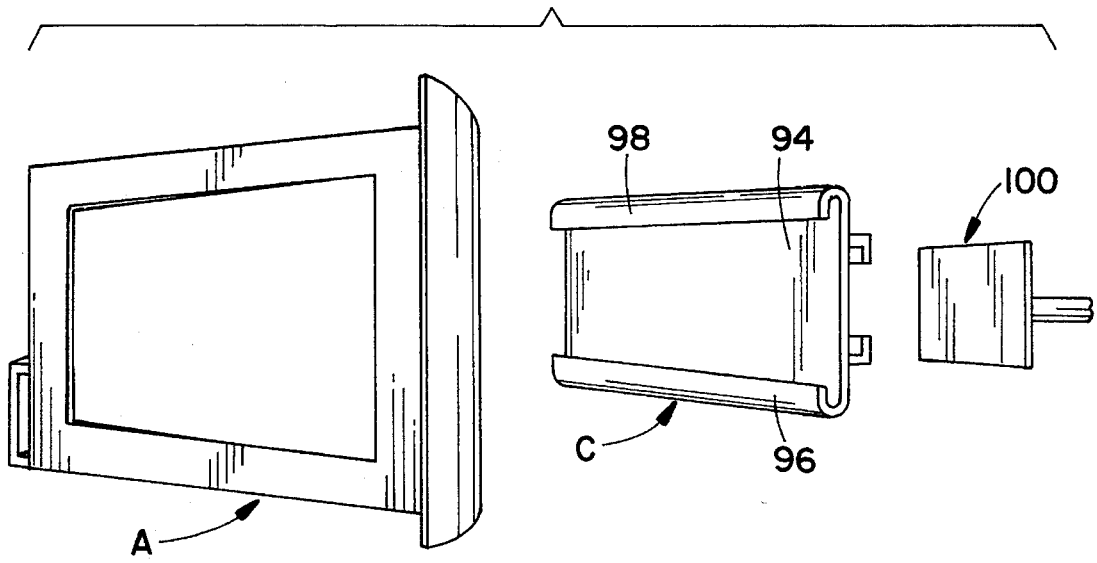
FIG. 9 is an exploded perspective view showing the display and dispensing device of FIG. 1 together with a first type of adaptor, according to the present invention, and a UPC hook.
Figure 12:
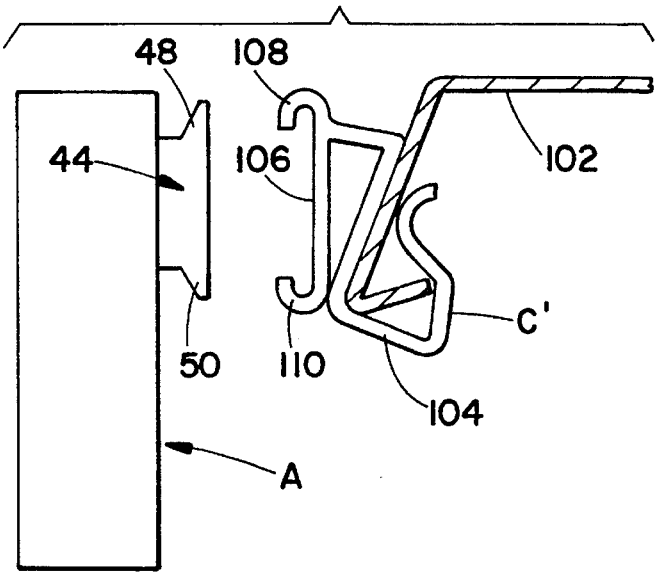
FIG. 12 is a side elevational view of the display and dispensing device of FIG. 1 being secured via an adaptor to a shelf.
Figure 14:
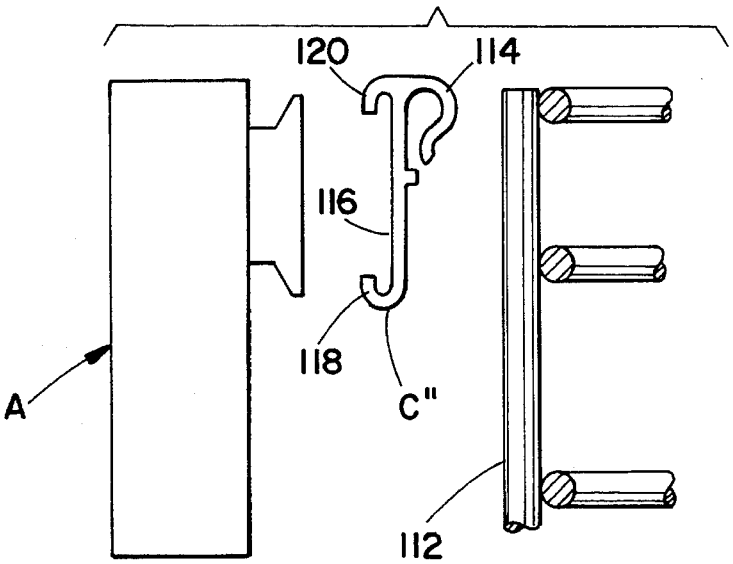
FIG. 14 is a side elevational view of the display and dispensing device of FIG. 1 being secured via an adaptor to a wire basket; and, FIG. 15 is an exploded perspective view of a third display and dispensing device according to the present invention, the device being in an open position in order to accommodate a stack of sheets.

Still other means for securing the display and dispensing device A to a suitable support member by means of an adaptor are illustrated in FIGS. 9, 12 and 14. With reference, first, to FIG. 9, the display and dispensing device A is first secured to an adaptor C which, in this case, comprises an adaptor suitably sized so as to slide onto a UPC hook 100. The adaptor includes a receiving opening 94 flanked by first and second flanges 96,98. These flanges cooperate with the suitable flanges on the bracket construction, as has been illustrated in previous embodiments.

With reference now to FIG. 12, a different form of adaptor C' is there illustrated. This adaptor is meant to slide or hook onto a known type of shelf 102. The adaptor is provided with a shelf engaging section 104 and a receiving opening 106 flanked by first and second flanges 108,110. As in the previous embodiments, these flanges 106,108 cooperate with suitably sized and shaped flanges 48,50 of the bracket construction 44 on the display and dispensing device A.

With reference now to FIG. 14, a different form of adaptor C" is there illustrated. This adaptor is particularly configured to be useful in connection with wire shelving 112. To that end, the adaptor C" is provided with a wire engaging section 114 that hooks over a portion of the wire shelving 112 and a receiving opening 116 which is provided with a mating set of flanges 118,120.

Figure 4:
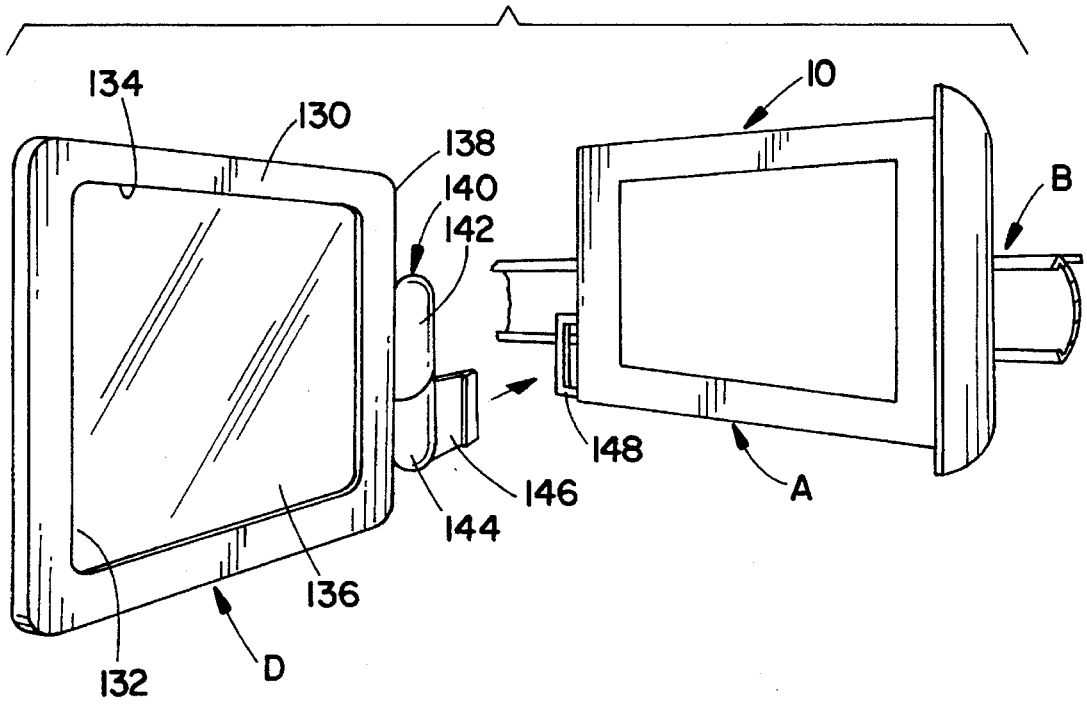
FIG. 4 is an exploded perspective view of the device of FIG. 1 on a reduced scale, with a first type of sign securable thereto according to the present invention.

With reference now to FIG. 4, if desired a suitable sign D can be selectively secured to the display and dispensing adaptor A. To that end, the sign can comprise a frame member 130 which forms a cavity 132 for accommodating a suitable sheet of promotional material or the like. If desired, the opening 134 formed by the frame on each side can be closed by a window 136. Provided on one side edge 138 of the frame 130 is a clip 140. The clip can have a first section 142 secured to the frame 130 and a second section 144 which is pivotally mounted in the first section. The second section is provided with a tab 146 which is suitably shaped and sized so as to be able to be selectively accommodated within a mounting structure or housing 148 located on the first side wall 16 on the device A. In this way, the sign D can be selectively secured to and detached from the device A.

In the embodiment illustrated in FIG. 4, the clip 140 preferably comprises a first means for permitting the sign C to pivot around a vertical axis in relation to the device frame 10 and a second means for biasing the sign to an orientation substantially normal to the orientation of the device frame 10. As showing in FIG. 7, therefore, the sign D will pivot in relation to the display and dispensing device A and the support member B. Such pivoting enables the sign to rotate out of the way of a shopper passing by the shelf to which the device A is secured. The sign D is self centering and will, if moved, pivot back to its position normal to the frame 10 of the device A as shown.

If the sign D is not required, it can be detached from the device A by removing the tab 146 from the housing 148. The sign frame, including the first section 142 could, for example, be injection molded from a suitable thermoplastic material. The second section 144, which would be separately manufactured, could then be secured to the first section 142 in a conventional manner so as to allow the two sections to pivot in relation to each other. The sign D could be selectively openable so as to allow the insertion of a promotional sheet within the frame 130. If desired, the window 136 could be separately manufactured from a suitable thermoplastic such as polyvinylchloride (PVC) and suitably secured in the frame opening 134.

Figure 5:
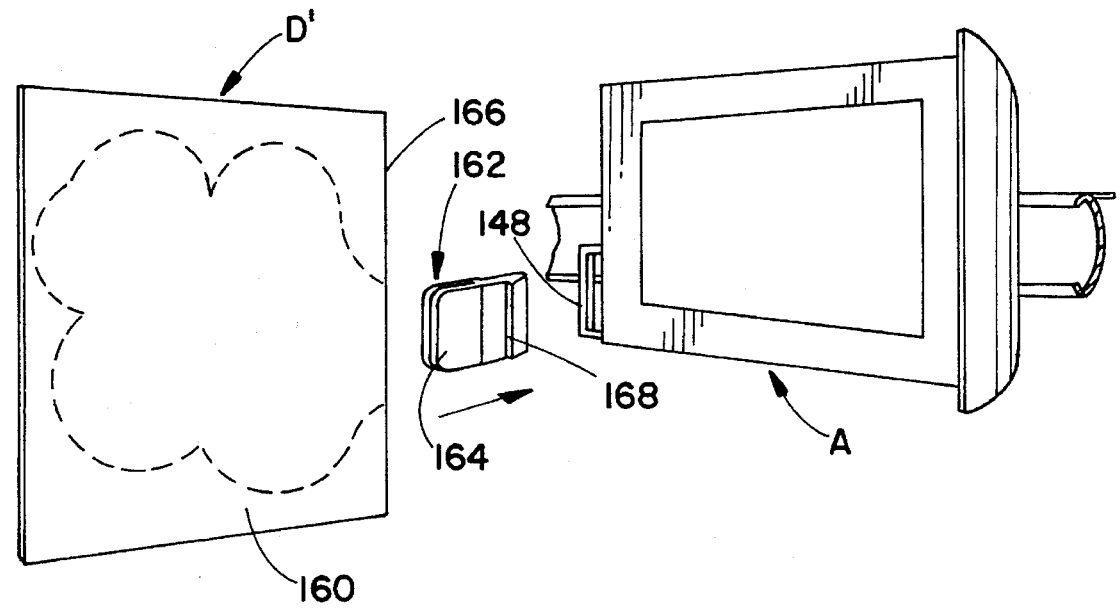
FIG. 5 is an exploded perspective view of the device of FIG. 1 showing a second type of sign securable thereto.

With reference now to FIG. 5, another type of sign D' is there illustrated. This type of sign merely includes a sheet 160 of material that is selectively secured to the display and dispensing device A by a clip 162. This-form of clip includes a first section 164 which engages a side edge 166 of the sheet 160. The clip also includes a second portion 168 which is adapted to be selectively mounted in the mounting structure 148 provided on the first side wall 16 of the frame 10.

With reference now to FIG. 6, yet another type of sign D" is there illustrated. The sign includes a display member 170 having a side edge 172 to which is secured a clip 174. This clip includes a first section 176 for accommodating the display member 170, and a second section 178 which is adapted to be mounted in the mounting structure 148. The clip 174 also includes a visual indicium in the way of a flashing light 180 or the like. As with the clips of FIGS. 4 and 5, the clip 174 illustrated in FIG. 6 is selectively detachable from the display and dispensing structure A.

Figure 8:
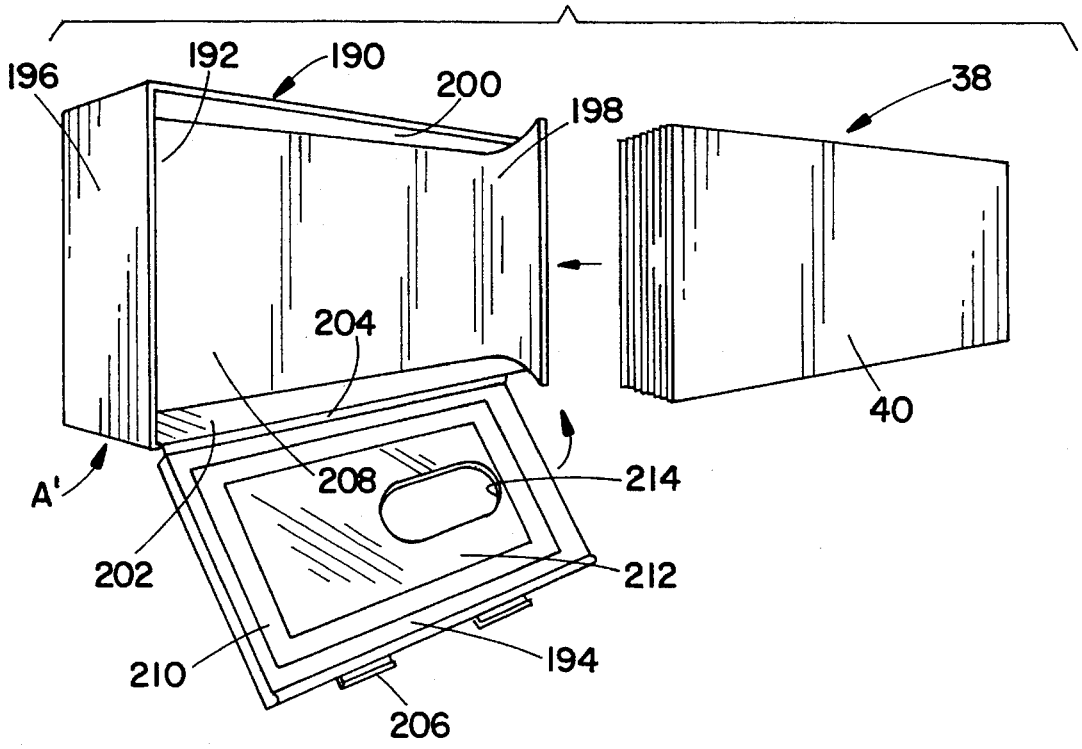
FIG. 8 is a perspective view of a second display and dispensing device according to the present invention, the device is in an open position in order to accommodate a stack of sheets.

With reference to FIG. 8, a different type of display and dispensing device A' is there illustrated. This device includes a frame 190 having a rear wall 192, a front wall 194, a first side wall 196, and a second side wall 198. The frame further includes a top wall 200 and a bottom wall 202. In this embodiment, the front wall 194 is secured by a hinge means 204 from the front edge of the bottom wall 202. Provided along the top edge of the front wall 194 is a catch means 206 which can secure the front wall 194 to the top wall 200. As is evident, a cavity 208 is formed by the frame 190 so as to receive a stack of sheets 38 comprising a plurality of individual sheets 40. In the embodiment of FIG. 8, the front wall 194 comprises a frame 210 in which is positioned a window 212, so that the contents of the frame are visible. Located in the window 212 is a finger receiving opening 214 which enables individual sheets 40 to be withdrawn from the frame along the second side edge 198, as explained previously in connection with the embodiment of the display and dispenser device shown in FIG. 2.

The display and dispensing device A' could be manufactured from any suitable material. One particularly advantageous form of material would be a thermoplastic such as polypropylene. The window 212 could be manufactured from a suitable thermoplastic such as PVC. Alternatively, the window could be made from glass. If desired, the device A' could be injection molded without the window 212. The window would then be later secured to the front wall 194 by any suitable conventional adhesion means.

Figure 15:
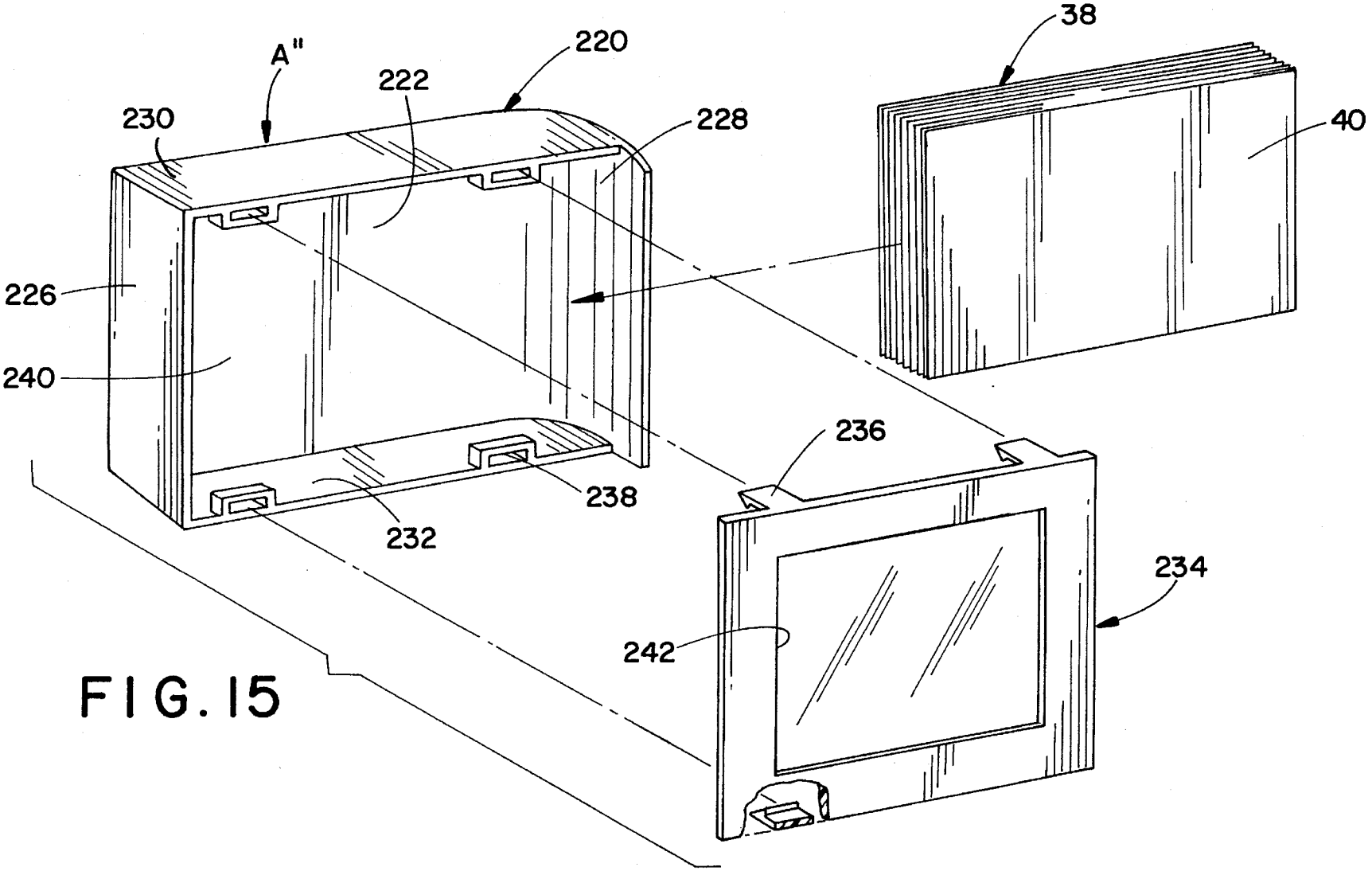

With reference now to FIG. 15, a different type of display and dispensing device A" is there illustrated. This device includes a frame 220 having a rear wall 222 as well as first and second side walls 226 and 228 and top and bottom walls 230 and 232. Thus a box-like frame having an open front is disclosed. A cover 234 is selectively secured to the frame 220.

Catch means are provided for this purpose. The catch means preferably comprise tabs 236 located on the cover 234 and tab housings 238 located on the frame 220. It is evident from FIG. 15 that tabs 236 are provided on both the upper and lower edges of the cover 234. Similarly, suitable tab housings 236 are provided on the upper wall 230 and lower wall 232 of the frame 220. The tabs are so sized and spaced as to be selectively received within the tab housings to secure the cover to the frame. It should be recognized by those of average skill in the art, however, that the tabs 236 could alternatively be provided on the frame 220 with the tab housings 238 being provided on the cover 234. Also, while two tabs are shown as being located on each edge, any suitable number can be provided. Further, tabs or tab housings could be provided on the first side wall 226 if desired. The second side wall 228 must, however, be free of obstructions.

As is evident, a cavity 240 is formed by the frame 220 so as to receive a stack of sheets 38 comprising a plurality of individual sheets 40. The cover 234 preferably includes a window 242 so that the front sheet 40 of the stack 38 is visible. Individual sheets can be withdrawn from the frame along the second side edge 228, as explained previously in connection with the embodiment of FIG. 2. That is, the sheets 40 are withdrawn one at a time from the dispenser A". The sheets slide along the second side wall 228, which is curved, such that the sheets 40 wind up in an orientation perpendicular to the stack 38.

As with the previous embodiments, the display and dispensing device, A" is preferably manufactured from a suitable material such as polypropylene or the like.

The invention has been described with reference to several preferred embodiments. Obviously, alterations and modifications will occur to others upon a reading and understanding of the specification. It is intended to include all such modifications and alterations insofar as they come within the scope of the appended claims or the equivalents thereof.

What is claimed is:

1. A device for displaying and dispensing sheets of promotional material, comprising:

a frame comprising:

a rear wall and a front wall, a pair of side walls, and a top wall and a bottom wall, wherein said walls cooperate to define a sheet-receiving cavity;

a hinge construction for pivotally mounting said front wall from the remainder of said frame;

a securing means located on said rear wall for securing said frame to an associated support member; and, a slot defined along one of said side walls for allowing the withdrawal of sheets from said cavity, wherein said one of said side walls comprises a curved extension which orients sheets withdrawn in a direction approximately normal to a plane of said front wall.

2. The device of claim 1 further comprising a catch construction for securing said front wall to the remainder of said frame when said front wall is in a closed position.

3. The device of claim 1 further comprising an adaptor which cooperates with said [bracket construction] securing means and enables said frame to be mounted from another support member.

4. The device of claim 1 wherein said frame and said hinge construction are of one piece.

5. The device of claim 1 wherein said front wall includes a window through which the sheets can be viewed.

6. The device of claim 1 wherein said front wall includes a finger receiving opening to allow an observer to manually grasp a sheet for extraction from said cavity.

7. The device of claim 1 further comprising:

a sign;

a clip having first and second ends, said sign being secured to said first end of said clip; and, a mounting structure located on a side wall of said frame opposite said slot, said second end of said clip being selectively insertable into said mounting structure to secure said sign to said frame.

8. The device of claim 7 wherein a plane in which said sign extends is substantially normal to a plane in which said frame back wall extends.

9. The device of claim 7 further comprising:

a first means for permitting said sign to pivot around a vertical axis in relation to said frame; and, a second means for biasing said sign to an orientation substantially normal to an orientation of said frame.

10. A sheet dispenser device, comprising:

a box-like frame member defining a cavity, said frame having an open front face;

a cover selectively mounted on said frame member for closing said open front face of said frame member;

a catch means for selectively securing said cover to said frame member;

means for allowing sheets to be moved into and out of said cavity, said allowing means comprising:

said open front face including a first opening for bulk loading the sheets into said cavity, and a second opening for dispensing individual sheets from the cavity;

a sign;

a clip having first and second ends, said sign being secured to said first end of said clip; and, a mounting structure located on a side wall of said frame opposite a side wall on which said second opening is located, said second end of said clip being selectively insertable into said mounting structure to secure said sign to said frame.

11. The device of claim 10 wherein said catch means comprises:

a tab located on one of said cover and said frame member; and, a tab housing located on another of said cover and frame member, said tab being selectively receivable in said tab housing.

12. The device of claim 10 wherein a side wall of said box-like frame member is curved, said side wall being located adjacent said second opening for dispensing individual sheets from the cavity.

13. The device of claim 10 wherein said cover includes a means for grasping a top sheet of the sheens held in the cavity.

14. The device of claim 10 wherein a plane in which said sign extends is substantially normal to a plane in which said frame extends.

15. The device of claim 10 further comprising:

a first means for permitting said sign to pivot around a vertical axis in relation to said frame; and, a second means for biasing said sign to an orientation substantially normal to an orientation of said frame.

16. A sheet display and dispensing device comprising:

a box-like frame member having a cavity, said frame having an open front face;

a cover selectively mounted on said frame member for closing said open front face of said frame member;

a catch means for selectively securing said cover to said frame member;

a means for assisting the bulk loading of sheets into the cavity when said cover is not closing said open front face of said frame member; and, a dispensing opening for dispensing individual sheets from the cavity when said cover closes said open front face of said frame member, said dispensing opening being defined along a wall of said frame member, wherein said wall comprises a curved surface which orients sheets withdrawn in a direction approximately normal to a plane of said cover.

17. The device of claim 16 wherein said cover includes a window through which the sheets can be viewed.

18. The device of claim 16 wherein said cover includes a finger receiving opening to allow an observer to manually grasp a sheet for extraction from said cavity.

19. The device of claim 16 wherein said catch means comprises a tab located on one of said frame member and said cover; and, a tab housing located on another of said frame member and said cover, said tab being selectively receivable in said tab housing.

20. The device of claim 16 further comprising a hinge construction for pivotally mounting said cover from said frame member.

21. The device of claim 20 wherein said frame member cover and hinge construction are of one piece.

22. The device of claim 16 further comprising a bracket construction located on said frame member for securing said frame member to an associated support.

23. The device of claim 22 further comprising an adaptor which cooperates with said bracket construction and enables said frame member to be mounted from another associated support.

24. The device of claim 16 further comprising a securing means for fastening said frame member to an associated support.

* * * * *